United States Patent [19]

Bader et al.

[11] 4,259,754

[45] Apr. 7, 1981

[54] PORTABLE BIDET

[76] Inventors: Jacob Bader; Aviv Bader, both of 878 La Senda Way, Chula Vista, Calif. 92010

[21] Appl. No.: 86,269

[22] Filed: Oct. 19, 1979

[51] Int. Cl.[3] ..... A61H 35/00; A47K 3/22

[52] U.S. Cl. ..... 4/443; 4/448; 4/420.4

[58] Field of Search ..... 4/448, 443, 444, 448, 4/420.1, 420.2, 420.3, 420.4, 420.5

[56] References Cited

U.S. PATENT DOCUMENTS

| | | | |
|---|---|---|---|
| 1,962,014 | 6/1934 | Guidetti | 4/420.4 |
| 2,344,561 | 3/1944 | Popil | 4/420.2 |
| 2,705,495 | 4/1955 | Vrana | 4/420.1 X |
| 3,256,531 | 6/1966 | Arensberg | 4/448 |
| 3,430,268 | 3/1969 | Zoberg | 4/420.4 X |
| 3,570,015 | 3/1971 | Rosengaus | 4/420.4 |
| 3,602,921 | 9/1971 | Ulmann | 4/448 |
| 3,808,608 | 5/1974 | Caplan | 4/448 |
| 3,810,260 | 5/1974 | Lodi | 4/420.4 |
| 3,914,804 | 10/1975 | Schrader et al. | 4/420.4 X |
| 4,062,072 | 12/1977 | Roberts | 4/420.4 |

FOREIGN PATENT DOCUMENTS

| | | | |
|---|---|---|---|
| 1956579 | 5/1971 | Fed. Rep. of Germany | 4/443 |
| 2410717 | 9/1974 | Fed. Rep. of Germany | 4/420.4 |
| 879079 | 6/1953 | Netherlands | 4/420.4 |

*Primary Examiner*—Henry K. Artis
*Attorney, Agent, or Firm*—Brown & Martin

[57] ABSTRACT

A portable and rechargeable self-contained bidet for use in conjunction with toilet fixtures which controllably dispenses a contained water solution under pressure. A cylindrically shaped reservoir provided with an integral mounting bracket which passes between the lowered seat and the toilet bowl supports the reservoir adjacent to the exterior rim of the toilet bowl. The free end of the mounting bracket further extends into, thence inwardly and downwardly into the interior of the toilet bowl. A directable spray nozzle is located adjacent to the terminus of the free end of the mounting bracket. The reservoir contains the douche solution, and is provided with a spring biased piston by which pressure is maintained on the stored solution. An inlet valve permits charging of the reservoir with water under pressure from an available source through a hose connection. A discharge passage within the mounting bracket connects the reservoir interior to the inlet of the directable spray nozzle. A control valve at the reservoir end of the discharge passage permits desired pressurized solution flow from the reservoir interior to the spray nozzle, and thence against the user's body.

8 Claims, 3 Drawing Figures

PORTABLE BIDET

BACKGROUND OF THE INVENTION

The invention pertains to a portable self-contained bidet for temporary use in conjunction with customarily available toilet fixtures.

Bidets provide a useful and convenient means for the conduct of personal hygiene, and for the application of medical treatment to the human body. However, installation of such devices as bathing fixtures is not customary in many sanitary facility installations. As a result, various portable attachments, devices, and methods have been used in an effort to achieve equivalent results by utilizing toilet installations that are readily available. Previous portable bidets characteristically have several interconnected components which make them cumbersome to install and operate. Some require permanent or semi-permanent connections to the toilet bowl, its seat, or bathroom piping, while others require separate interconnected pumping mechanisms, mixing containers, and applicators. These features lessen the portability of the prior bidets and complicate their operation. Additionally, separately hose connected parts present difficulties in draining, cleaning, and storage of the devices.

The disclosed device avoids these difficulties by providing a unitized easily mounted portable bidet which is an effective and compact device for providing the bidet function in conjunction with available toilet facilities.

SUMMARY OF THE INVENTION

The disclosed device is a single self-contained unit that mounts to the exterior rim of the toilet bowl. A hollow cylindrically shaped reservoir contains the douche solution. An integral mounting bracket extends laterally from the top of the reservoir for a distance sufficient to span the width of a toilet bowl rim. The bracket then takes a ninety degree angle turn so as to run parallel to the length of the reservoir, for a distance approximately equal to the depth of the support rim of the toilet bowl. The mounting bracket is a flat generally rectangular shaped member sized in thickness to pass between the lowered toilet seat and bowl rim without interference. The shape and lengths of the initial sections of the mounting bracket in conjunction with the adjacent reservoir body form a hanger to support the bidet over the rim of the toilet bowl. The free end of the mounting bracket extends further downwardly and inwardly toward the interior of the toilet bowl terminating in an angled surface for mounting a directable spray nozzle located on the upper face of the bracket. The length and downward angle of the free end of the mounting bracket is such that in its straight position, the nozzle is directed upward and toward the center of the toilet seat area of the toilet bowl.

The reservoir contains a spring biased piston which maintains a constant discharge pressure upon the solution contained within the reservoir. An inlet valve located atop the reservoir permits charging of the reservoir with water from an available tap by use of a hose equipped with readily available fittings. Desired ingredients for the douche may also be added through this valve. The discharge passage of the bidet is formed within the mounting bracket and connects the interior of the reservoir to the inlet of the spray nozzle. A manually operated valve located at the reservoir end of the discharge passage allows control of the desired volume of flow of solution through the discharge passage and the bidet spray nozzle against the user's body.

The bottom of the reservoir is closed by a spring backing disc and removable end cap which allows access to the interior of the reservoir for cleaning and removal of the spring and piston for maintenance.

The primary object of the invention is to provide a new and improved portable bidet for use with the usually available toilet facilities. The disclosed device is a single compact unit. The reservoir is formed ABS plastic and the piston is aluminum to achieve the advantages of light weight and ease of maintenance, but other materials could be used. The compact nature and size of the device allows it to be easily stored, or packed for traveling. Temporary attachment of the bidet on the toilet fixture is readily accomplished. The bidet controllably directs water under pressure or a hygienic solution to a selected localized area without the need for ancillary components. It is easily used, and of simple and sturdy construction. The device may be easily disassembled for cleaning and maintenance.

These together with other advantages will become apparent in considering the details of construction and operation of the bidet as they are more fully described with reference to the accompanying drawings in which.

DETAILED DESCRIPTION OF THE INVENTION

Figure 1:
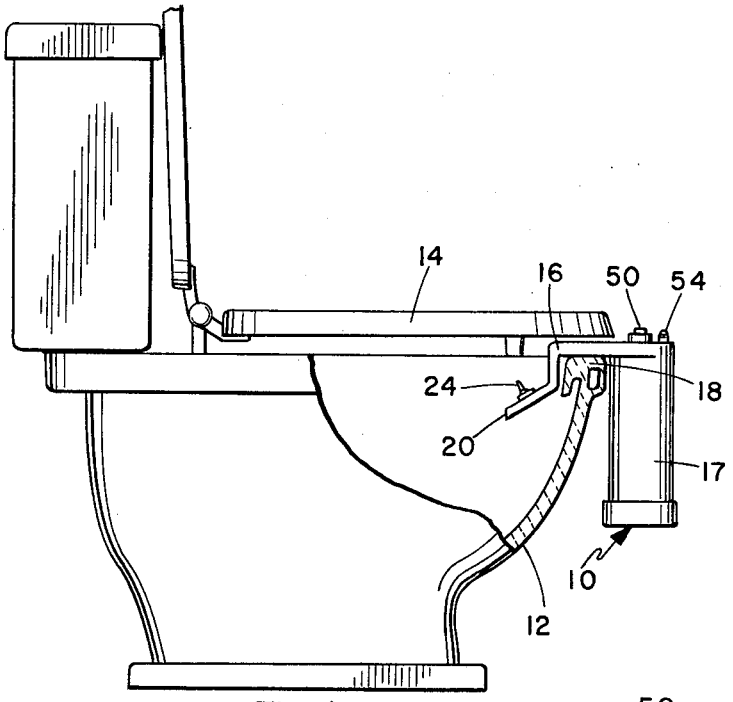
FIG. 1 illustrates the bidet unit mounted on a toilet bowl.

In FIG. 1, the bidet unit 10 is shown mounted upon a toilet bowl 12 fitted with a toilet seat 14. Bidet unit 10 has two principal components, namely reservoir 17 and an integral mounting bracket 16. Mounting bracket 16 is a flat rectangular shaped member sized in depth to pass under lowered toilet seat 14, and fit over the rim 18 of the toilet bowl 12. The free end 20 of mounting bracket 16 extends downward and inward toward the center of toilet bowl 12. The free end 20 of the mounting bracket 16 thus provides an upper surface or pedestal 22 in which is located a directable spray nozzle 24.

Figure 2:
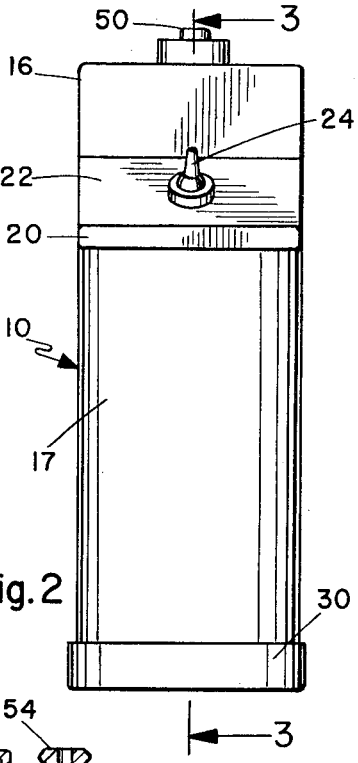
FIG. 2 is an enlarged front elevation view of the unit showing the free end of the mounting bracket and mounted directable nozzle.
Figure 3:
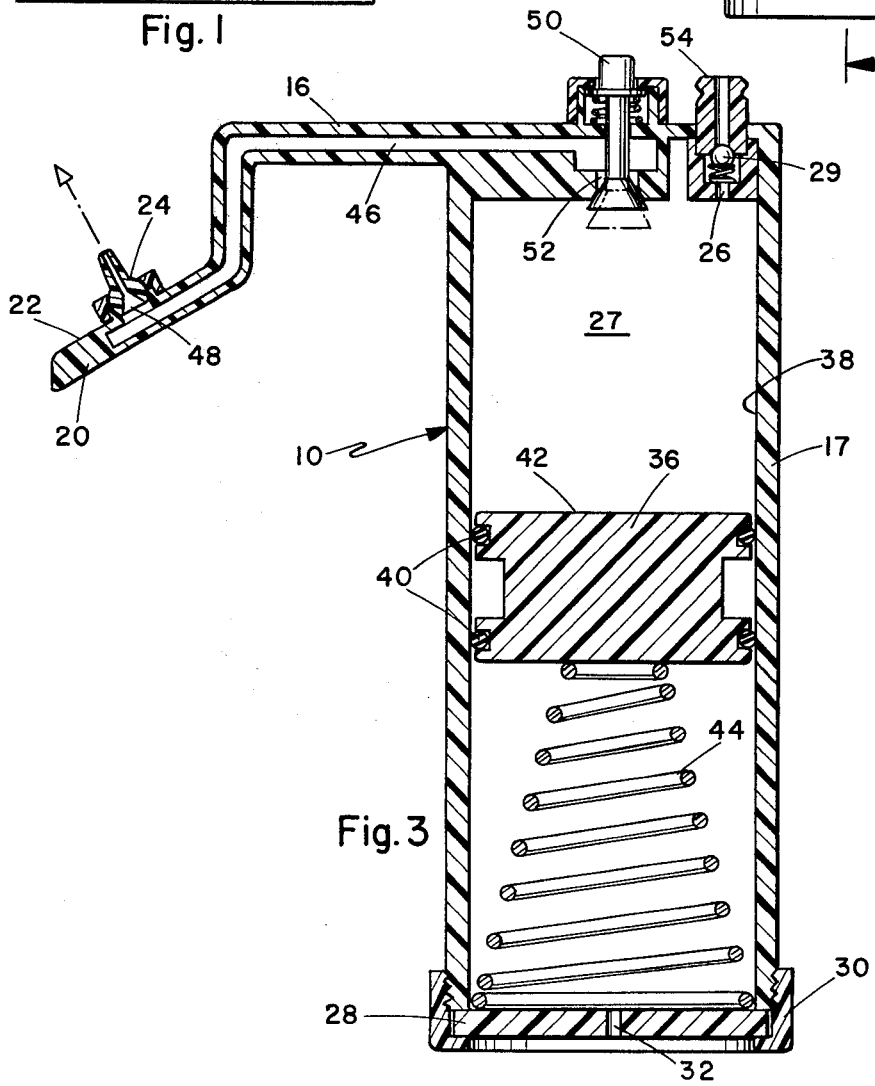
FIG. 3 is an enlarged sectional view taken on line 3—3 of FIG. 2.

FIG. 2 depicts a front elevation view of bidet unit 10, showing the mounting of nozzle 24, while the details of its construction are shown in the cutaway view of FIG. 3. Reservoir 17 is a hollow cylindrical member. The upper end of reservoir 17 is closed except for entry port 26 which is normally closed by the unidirectional charging valve 29. The upper interior portion 27 of reservoir 17 is charged with water through valve 29. The lower end of reservoir 17 is closed by spring backing disc 28 and removable cap 30. Backing disc 28 is provided with a vent hole 32.

Piston 36 is positioned within the bore 38 of reservoir 17, and is free to travel longitudinally therein, with O-rings 40 forming a seal between the piston 36 and the bore 38. Upper surface 42 of the piston 36 is in contact with the solution contained within the upper portion 27 of the reservoir. A constant force spring 44 is positioned between the piston 36 and the spring backing disc 28, biased to maintain a pressure on the solution contained within the upper interior portion of the reservoir 27.

Discharge passage 46 is contained within mounting bracket 16 and connects the inlet 48 of spray nozzle 24 to the upper interior portion 27 of reservoir 17. A manually operated, normally closed, control valve 50 regulates the flow of pressurized solution at the inlet 52 of the discharge passage 46, and consequently the flow from the spray nozzle 24.

The operation of the bidet unit 10 is explained using FIG. 3 which represents a unit partially charged with solution. The bidet may be charged with water under pressure and of desired temperature, obtained from an available tap supply employing available hose and fittings not shown. Inlet fitting 54 represents a quick release hose connection for charging reservoir 17. Prior to charging the bidet, desired douche or medicinal ingredients may be introduced into the reservoir 17 through fitting 54 and charging valve 29. As reservoir 17 is charged with water through valve 29, the piston 36 is caused to move downward towards its end cap 30, and coming to rest when the upper interior portion 27 of the reservoir is full. The charging hose is then disconnected from inlet fitting 54 and the bidet is ready for use.

With the bidet 10 installed on the toilet bowl 12 as shown in FIG. 1, the user positions spray nozzle 24 in the desired direction, and depresses control valve 50 to obtain the desired flow volume of solution against the body. As the solution within the bidet is depleted, piston 36 moves upward under the force of spring 44 maintaining constant solution pressure within reservoir 17. When the solution content of bidet unit 10 is depleted, the unit may be recharged and used again.

Having described our invention, we claim:

1. A portable bidet for use in conjunction with a toilet bowl comprising:

a solution reservoir to store a douche water solution;

reservoir means for maintaining pressure on the stored solution within the reservoir;

a mounting bracket extending laterally from the reservoir for mounting the reservoir adjacent to the exterior rim of said toilet bowl;

the mounting bracket having a free end extending into the interior of the toilet bowl;

a directable spray nozzle with an upward orientation located in the free end of the mounting bracket for directing the discharge of solution from the reservoir;

a discharge passage connecting the nozzle input to the interior of the solution reservoir;

means for controlling the solution discharge through the discharge passage and nozzle;

means for charging the reservoir with a solution having selectable temperature and content characteristics.

2. A portable bidet as recited in claim 1 wherein the mounting bracket is formed integrally with the reservoir.

3. A portable bidet as recited in claim 1 wherein:

the free end of the mounting bracket terminates in an angled surface directed downwardly and inwardly into the interior of said toilet bowl forming a mounting for the directable spray nozzle.

4. A portable bidet as recited in claim 1 wherein:

the solution reservoir is formed as a hollow cylinder closed at its first end and closeable but vented to the atmosphere at its second end.

5. A portable bidet as recited in claim 1 wherein the solution pressure maintaining means comprises:

a piston located within the reservoir;

one face of the piston being in contact with the solution stored within the reservoir;

a constant force spring biased to cause the piston to exert a force against the stored solution and spaced between the piston and the vented end of the reservoir;

means for maintaining a solution type seal between the piston and the cylinder interior.

6. A portable bidet as recited in claim 4 wherein:

the cylinder is closed by a removable cap at the vented end to permit access to the cylinder interior and removal of the piston and the spring for maintenance and cleaning.

7. A portable bidet as recited in claim 1 wherein the discharge means comprises:

a discharge passage contained within the mounting bracket and connecting the interior of the reservoir to the inlet of the discharge nozzle.

8. A portable bidet as recited in claim 4 wherein the cylinder is formed of pressure rated plastic.

* * * * *